US009676007B1

(12) United States Patent
Kane et al.

(10) Patent No.: US 9,676,007 B1
(45) Date of Patent: Jun. 13, 2017

(54) APPARATUS AND METHOD FOR CLEANING HVAC COILS

(71) Applicants: Timothy Kane, Greenwich, CT (US); George Cruz, Stamford, CT (US)

(72) Inventors: Timothy Kane, Greenwich, CT (US); George Cruz, Stamford, CT (US)

(73) Assignee: CROSSFORD INTERNATIONAL, LLC, Stamford, CT (US)

( * ) Notice: Subject to any disclaimer, the term of this patent is extended or adjusted under 35 U.S.C. 154(b) by 0 days.

(21) Appl. No.: 13/999,628

(22) Filed: Mar. 13, 2014

(51) Int. Cl.
*F25B 47/00* (2006.01)
*F28G 9/00* (2006.01)
*B08B 3/02* (2006.01)
*B05B 1/02* (2006.01)

(52) U.S. Cl.
CPC ..... *B08B 3/026* (2013.01); *B05B 1/02* (2013.01); *B08B 3/028* (2013.01); *F25B 47/00* (2013.01); *F28G 9/00* (2013.01)

(58) Field of Classification Search
CPC ..... B08B 3/026; B08B 3/028; B05B 15/065; F25B 47/00; F28G 9/00
USPC ..... 239/525–532, 587.1–587.6, 588
See application file for complete search history.

(56) References Cited

U.S. PATENT DOCUMENTS 1,745,972 A * 2/1930 Beck ..... B05B 15/064 239/532
2,557,247 A * 6/1951 Ziherl ..... B05B 1/3442 222/324
3,915,382 A * 10/1975 Davis ..... B05B 15/064 239/195
4,457,472 A * 7/1984 Geberth, Jr. ..... B05B 15/064 239/281
5,022,586 A * 6/1991 Putnam ..... B05B 13/0436 134/167 C
5,116,425 A * 5/1992 Ruef ..... B08B 3/026 134/144
5,573,187 A * 11/1996 Proctor ..... B05B 13/0627 134/167 C
5,806,767 A * 9/1998 Polti ..... A47L 9/2836 239/135
5,947,039 A * 9/1999 Lundgren ..... B25G 1/102 111/7.1
5,947,388 A * 9/1999 Woodruff ..... B05B 15/066 239/532
5,976,631 A * 11/1999 Ramachandran ..... B05B 9/007 239/526
6,308,899 B1 * 10/2001 Crofford ..... B05B 9/0816 239/373
6,371,385 B1 * 4/2002 Schiller ..... B05B 7/2443 222/173
6,446,884 B1 * 9/2002 Utter ..... A01G 25/145 222/386

(Continued)

*Primary Examiner* — Arthur O Hall
*Assistant Examiner* — Joseph A Greenlund
(74) *Attorney, Agent, or Firm* — Patrick J. Walsh

(57) ABSTRACT

An apparatus and method for cleaning coils and fins of outdoor condenser units and the like in locations without electrical service wherein the apparatus comprises containers for water and cleaning chemical, a plumbing system for preparing and delivering a cleaning mixture, an electrical system for power, and wherein the method provides for cleaning coils by directing cleaning mixture through the coils in counter-flow to cooling air drawn through the coils by a condenser unit fan.

1 Claim, 15 Drawing Sheets

(56) References Cited

U.S. PATENT DOCUMENTS 6,511,001 B1 * 1/2003 Huang ..... B05B 15/066 239/526
6,540,163 B1 * 4/2003 Huang ..... B05B 15/066 239/280.5
6,554,213 B2 * 4/2003 Chen ..... B05B 15/066 239/394
6,595,439 B1 * 7/2003 Chen ..... B05B 15/066 239/225.1
6,632,195 B1 * 10/2003 Smith ..... A45D 34/04 604/275
6,685,115 B1 * 2/2004 Hardin ..... 239/587.1
6,695,115 B2 * 2/2004 Lindner ..... F16D 13/757 192/111.2
6,705,539 B1 * 3/2004 Bien ..... B05B 7/0408 239/10
6,889,920 B2 * 5/2005 Nance ..... B05B 15/061 239/280.5
6,913,211 B2 * 7/2005 Chen ..... F16L 27/12 239/280
6,976,644 B2 * 12/2005 Troudt ..... B05B 15/066 239/525
7,841,351 B1 * 11/2010 Kane ..... A01M 7/0046 134/172
8,235,621 B2 * 8/2012 Robinson ..... B05C 17/003 15/235.3
8,245,957 B2 * 8/2012 Zhang ..... B05B 15/066 239/532
D668,319 S * 10/2012 Kane ..... D23/213
8,708,254 B2 * 4/2014 Baxter ..... B05B 15/066 239/525
8,770,599 B1 * 7/2014 Kane ..... F28G 15/02 280/47.18
8,919,672 B2 * 12/2014 Chen ..... B05B 1/267 239/280.5
8,960,565 B2 * 2/2015 Rohner ..... B08B 3/02 137/334
2005/0031404 A1 * 2/2005 Tsai ..... A46B 11/063 401/188 R
2006/0283982 A1 * 12/2006 Wang ..... B05B 15/066 239/530
2010/0326470 A1 * 12/2010 Seippel ..... B08B 3/02 134/14
2012/0025497 A1 * 2/2012 Yoo ..... B60R 21/233 280/729
2012/0168535 A1 * 7/2012 Chen ..... A47L 1/08 239/532
2014/0352807 A1 * 12/2014 Liu ..... B08B 3/026 137/355.27

* cited by examiner

APPARATUS AND METHOD FOR CLEANING HVAC COILS

PRIORITY

This application is a division of application Ser. No. 12/283,083 filed Sep. 9, 2008, which is a continuation-in-part of U.S. application Ser. No. 11/103,209 filed Apr. 11, 2005.

BACKGROUND OF THE INVENTION

The present invention is directed to an apparatus and method for cleaning coils in HVAC installations including particularly the coils located in outdoor, rooftop and attic HVAC units and coils located where electricity is usually not available.

A typical HVAC installation for residential and commercial buildings includes an outdoor condenser unit having heat exchange coils, indoor evaporator units having heat exchange fin and coil combinations with water condensate collection trays and drain lines located in ductwork, and air handling components.

Outdoor condenser coils are arranged in banks at the outer periphery of a condenser unit and are cooled with ambient air drawn through the coils by an electric fan. In operation, the coils accumulate deposits of pollen, grass clippings, insects, and so forth carried by ambient air drawn through the coils. In addition, the outdoor condenser coils develop an oxidized film or coating that diminishes heat exchange efficiency and requires periodic removal by chemical cleaning of the coil surface.

For optimum operating efficiency of HVAC installations, heat transfer coils must be cleaned from time to time of such deposits and coatings that build-up in normal operation and by natural processes (i.e., oxidation) with passage of time. The present invention provides an apparatus and method especially suited for cleaning outdoor coils in an effective manner so as to remove accumulated deposits and coil films or coatings which are detrimental to HVAC operating efficiency. The invention may be used for a routine maintenance schedule that checks building operating costs by ensuring thermal efficiency and extending the useful operating life of HVAC installations.

The invention provides an apparatus containing all components and consumable cleaners including water and chemical for cleaning HVAC coils situated in tough to reach areas, and further provides a method for effectively cleaning such coils.

SUMMARY OF THE INVENTION

The apparatus of the present invention comprises a portable machine having integrated operating components for movement from site to site for cleaning outdoor HVAC coils. The invention enables a time and labor efficient and an effective maintenance program for cleaning HVAC components.

In a preferred embodiment of the invention, the coil cleaning apparatus is a carryall comprising a base for housing operating components, together with separate containers for cleaning water and cleaning chemical mounted atop the base. The operating components include an electrical system for battery power operation of a motor driven pump for pressurized delivery of a cleaning water and chemical mixture, a plumbing system for pressure and flow regulation of cleaning fluid mixture, and for delivering an adjustable water and chemical mixture for cleaning coils with an applicator wand. Interchangeable nozzles provide for selection of spray pattern and flow rate appropriate to cleaning and rinsing operations.

In preferred embodiment the carryall base defines a compartment for enclosing and positioning electric power components including a DC power supply storage battery, battery re-charger circuit, motor driven pump, operating switch, fluid intake to the pump, and exterior connections for applicator wand and nozzles.

In a modified embodiment of the invention, the coil cleaning apparatus comprises a tank for supporting operating components and defining separate containers for cleaning water and cleaning chemical. An electrical system provides for battery power operation of a motor driven pump for pressurized delivery of a cleaning water and chemical mixture, a plumbing system for pressure and flow regulation of cleaning fluids, and for delivering an adjustable water and chemical mixture for cleaning coils with an applicator wand. Interchangeable nozzles provide for selection of spray pattern and flow rate appropriate to cleaning and rinsing operations.

In modified embodiment the tank has an inner compartment defining a water container and an exterior chemical container secured to a sidewall of the tank.

The tank body is recessed to define a compartment accessible from outside the tank for locating electric power components including a DC power supply storage battery, battery re-charger circuit, motor driven pump, operating switch, fluid intake to the pump, and exterior connections for applicator wand and nozzles.

In both preferred and modified arrangement, the HVAC coil cleaning apparatus is readily carried into position for coil cleaning and is particularly useful for access to outdoor and attic coils where electric service is normally not available.

In accordance with the both preferred and modified apparatus and method of the invention, an applicator wand enables an inside-to-outside cleaning of HVAC coil banks against the outside-to-inside direction of airflow through unit coils in normal operation. In a typical rooftop HVAC condenser coil unit, heat transfer coils are mounted vertically in framework along the outer sides of the unit. A cooling fan is situated horizontally in the topside of the unit. The fan draws ambient air more or less horizontally through the vertical heat transfer coils and directs exhaust airflow upwardly from the unit. Airflow through the unit is exterior-to-interior-to-exterior. Applicants have observed that such cooling air flow draws debris (grass clippings, insects, etc) from exterior sources to lodge lightly at the exterior side of coils and fins so as to impede air flow and to reduce coil heat transfer efficiency by reducing effective surface area of the coils. If not removed debris over time degrades to a pumice that promotes rusting of metal components especially framework of condenser units.

The method of the present invention using a water base cleaning solution flowing inside-to-outside of condenser unit coils against exterior-to-interior air flow is effective to push and dislodge debris from the coils and fins. It is to be understood that cleaning solution applied in the same direction as air flow (i.e., exterior-to-interior) is far less effective for coil cleaning because the cleaning solution would tend to drive lightly lodged debris more firmly in the coils and fins, and not clean the coils at all.

Grille work in the top side of the unit allows for access to the interior surface of the coils by means of an applicator wand so that the entire coil surface is cleaned by directing cleaning solution through the coils and fins from interior-to-exterior of the HVAC unit. The result is a thorough cleaning of the coils and the HVAC units by driving debris out of the delicate coils fins without harming them. Use of an applicator wand in this way obviates the need for dismantling a condenser unit for access to coil interior surface.

The applicator wand comprises an elongate hollow rod fitted at its distal end with a nozzle for directing cleaning solution in an interior-to-exterior direction through the entire area of unit coils for dislodging debris accumulated in the coils.

The coil cleaning invention is described with particular reference to cleaning outdoor HVAC coils, however, it is to be understood that HVAC condenser coils in any remote location can be cleaned by the invention.

Specific examples are included in the following description for purposes of clarity, but various details can be changed within the scope of the present invention.

OBJECTS OF THE INVENTION

An object of the invention is to provide an apparatus and method for cleaning HVAC condenser coils.

Another object of the invention is to provide a compact, portable, self-contained apparatus for cleaning HVAC coils located in outdoor condenser units and anywhere electric service is not available.

Another object of the invention is to provide coil cleaning apparatus and method for routine maintenance of HVAC equipment coils so as to control operating costs by maintaining thermal efficiency and by extending the useful life of HVAC equipment installed in residential and commercial buildings.

Another object of the invention is to provide a method for effective cleaning of condenser unit coils by issuing an interior-to-exterior flow of cleaning solution through coils against inflowing cooling air so as to dislodge accumulated debris.

Another object of the invention is to provide an applicator wand enabling interior-to-exterior application of cleaning fluid through HVAC coils in units located outdoors.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention pertains to readily understand how to construct and use the invention and is shown in the accompanying drawing in which.

DETAILED DESCRIPTION OF PREFERRED EMBODIMENT

Figure 1:
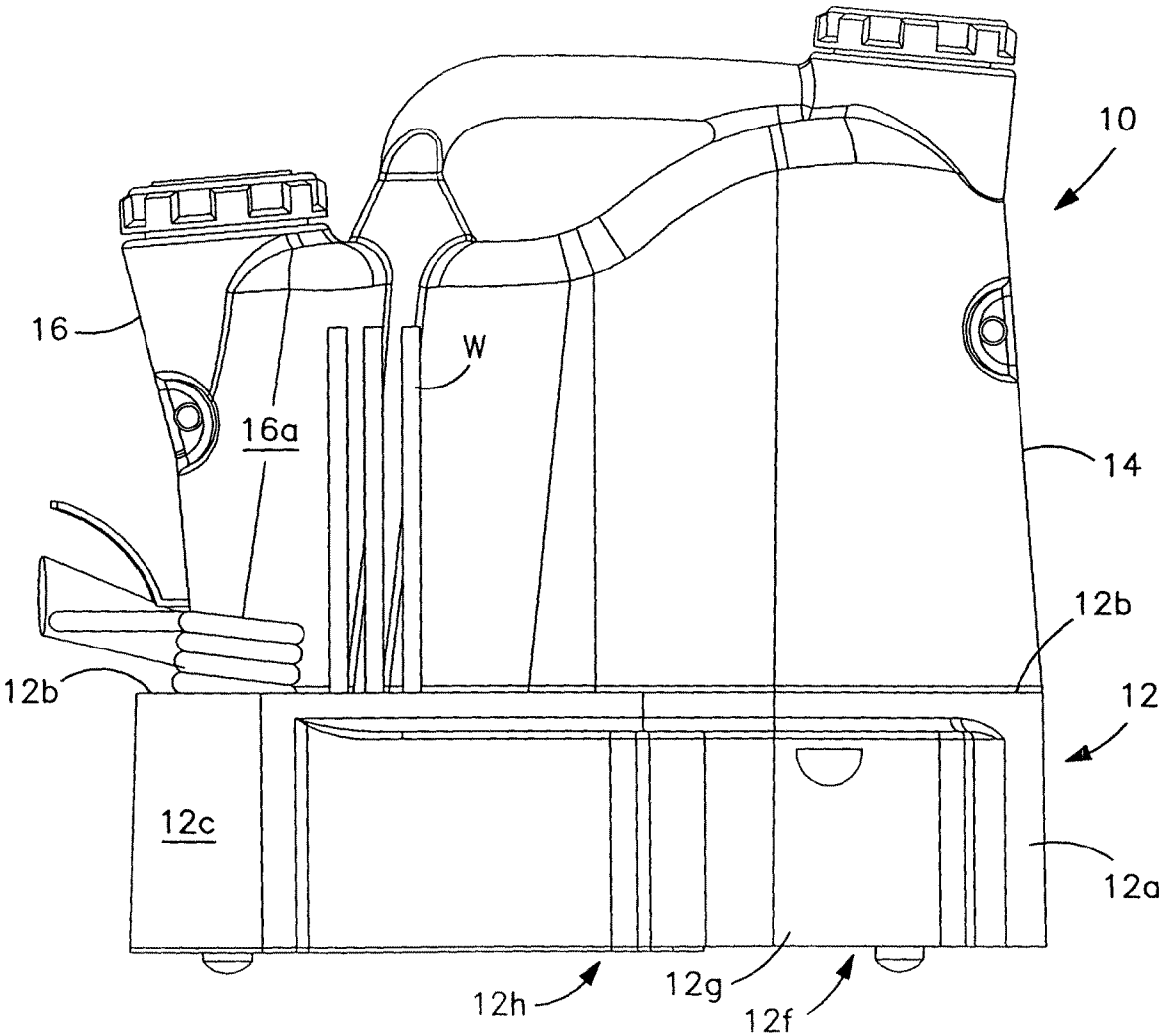
FIG. 1 is a right side elevation view of a preferred embodiment of coil cleaning apparatus according to the invention.
Figure 2:
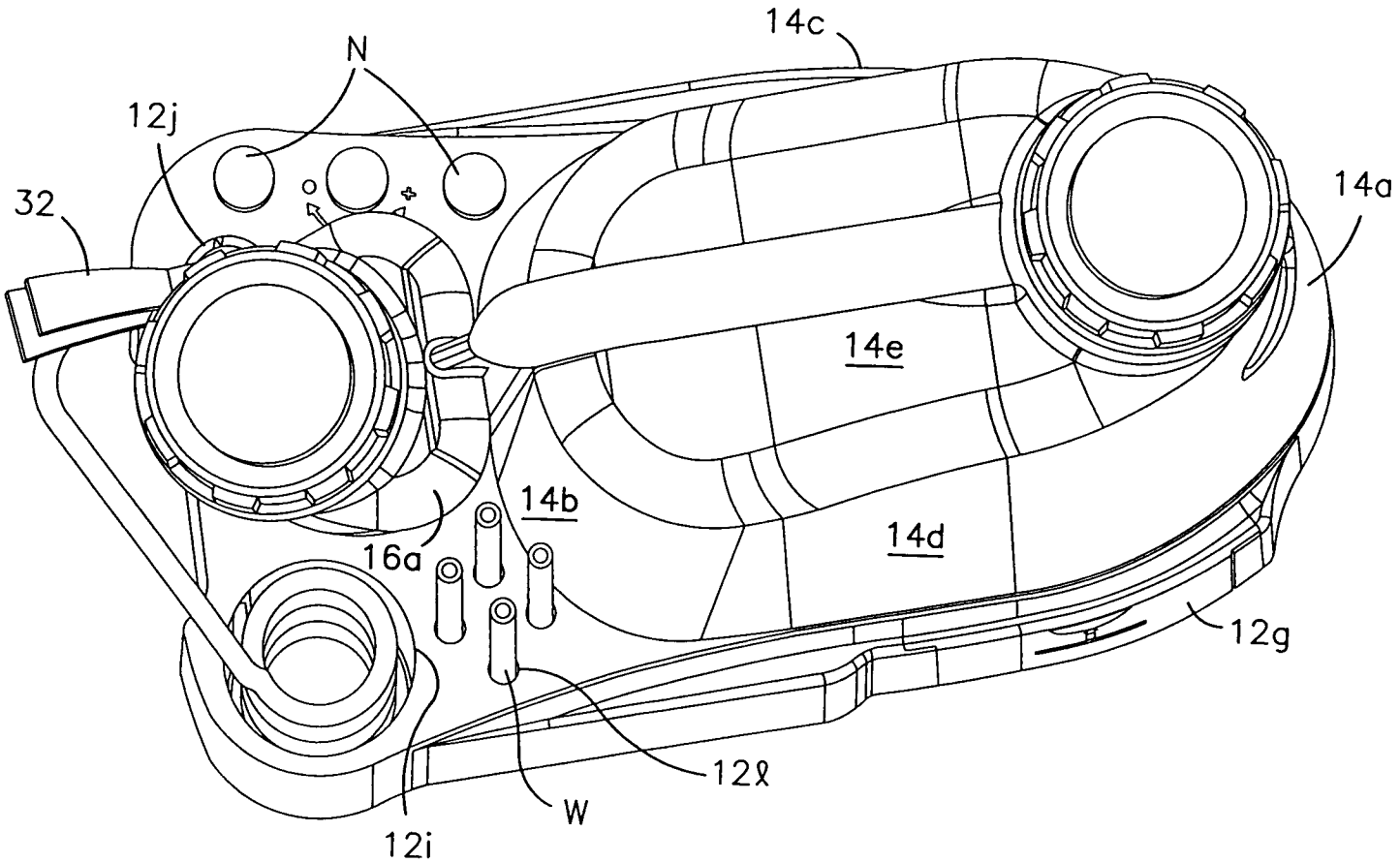
FIG. 2 is a top perspective view of the right side of the apparatus of FIG. 1.

Referring to FIGS. 1-6 of the drawing, a preferred embodiment of the invention comprises a carryall 10 including a base 12 for housing electrical and plumbing operating components of the apparatus, together with a water container 14 and a chemical container 16 positioned side-by-side on top of the base.

Figure 5:
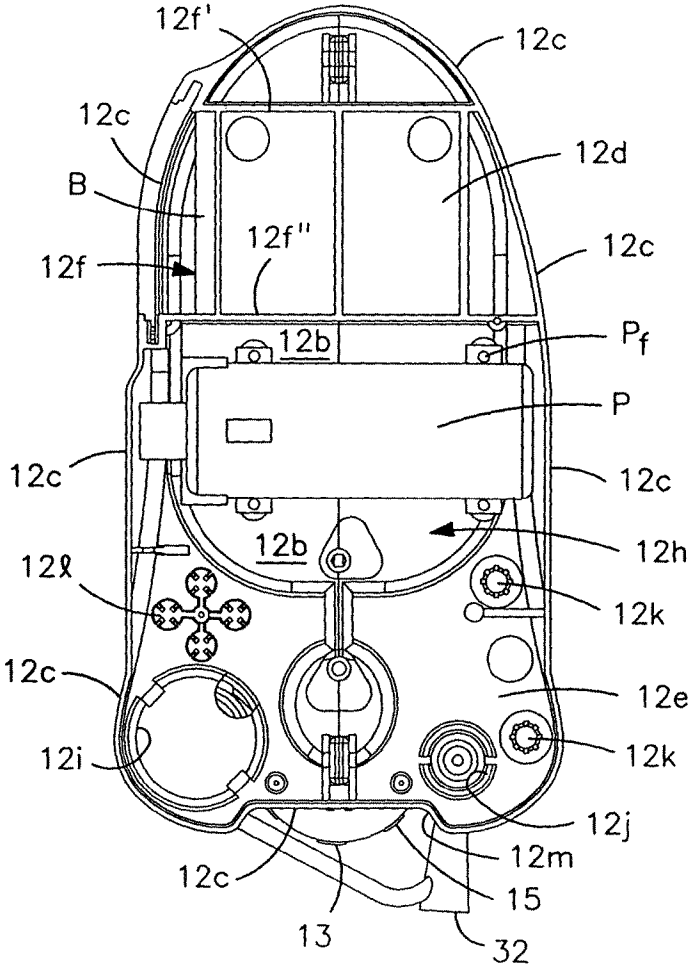
FIG. 5 is a bottom view of the apparatus of FIG. 1.
Figure 6:
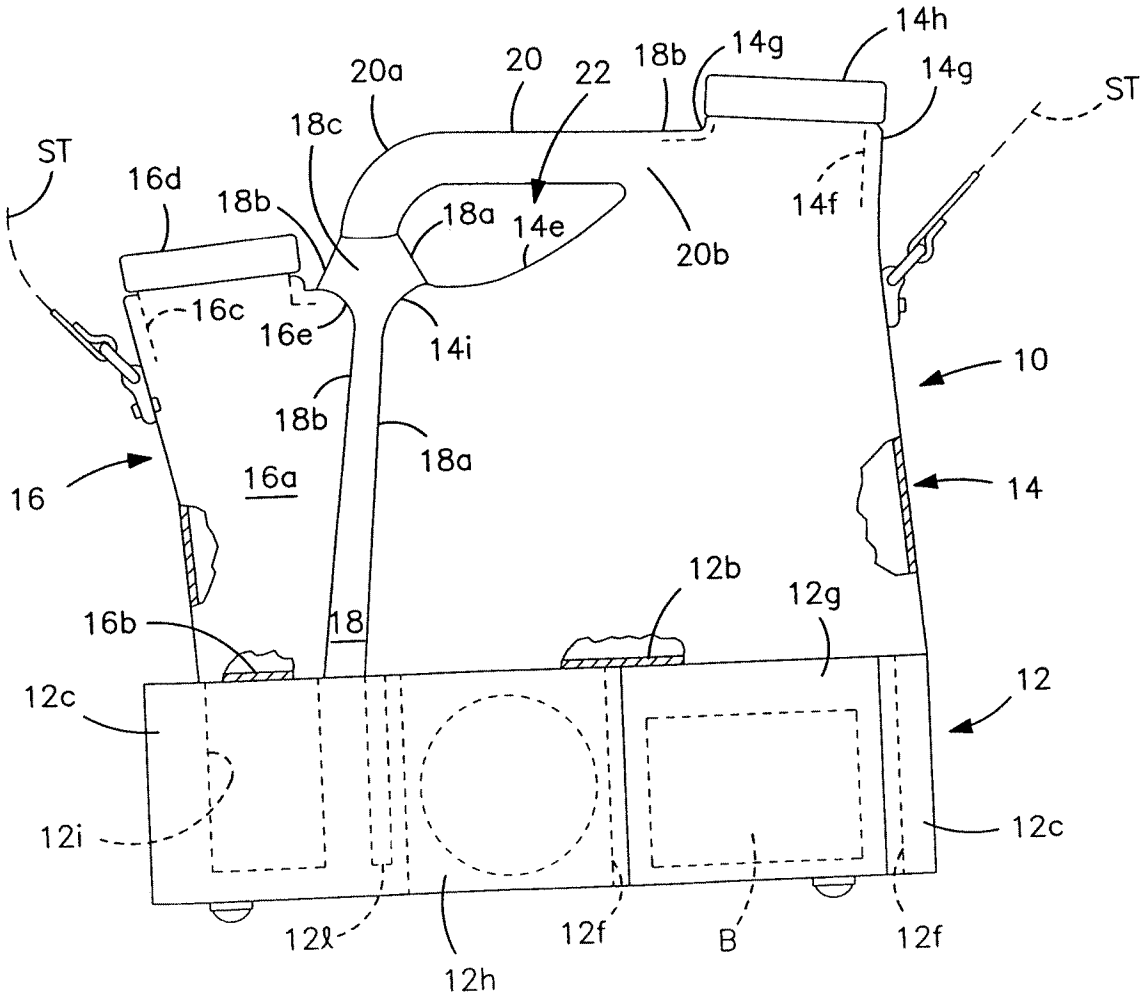
FIG. 6 is a side elevation of the apparatus of FIG. 1 showing location of principal components.

FIGS. 1, 5 and 6 illustrate the arrangement of main components of the preferred embodiment. The carryall comprises a base housing 12*a* defined by top strength wall 12*b*, a depending peripheral skirt 12*c*, and bottom base plates 12*d-e* (FIG. 5). The forward portion of base housing 12 has a first interior closed compartment 12*f* with entry through a removable door panel 12*g* for keeping an electric storage battery B. Interior compartment is defined by peripheral skirt 12*c*, strength wall 12*b*, bottom plate 12*d* and transverse walls 12*f'* and 12*f''* and provides a suitable enclosure for receiving storage battery B.

A second interior compartment in the form of an open recess 12*h* (FIG. 5) in the midsection of the base accommodates an electric motor driven water pump P mounted by suitable fasteners $P_f$ to the underside of the strength wall 12*b* for delivering a cleaning mixture for cleaning condenser coils. The open recess lies centrally of the base between the skirt 12*c* with the motor pump athwart the recess so as to center the weight of the motor pump with respect to the apparatus. Recess 12*h* is open in that there is no cover under the motor pump between base plates 12*d* and 12*e* permitting ready dissipation of heat emitted by the motor in operation.

The rear portion of the base is fitted with several pockets or wells 12*i*-1 opening through the top wall and extending downwardly into the base housing for storing or holding operating parts or accessories of the apparatus including hose pocket 12*i* for holding a coiled hose 30 through which cleaning solution is delivered to a coil being cleaned; spray gun pocket 12*j* for spray gun 32; nozzle pockets 12*k* for holding several spray nozzles N selected according to desired spray pattern; and extension wand pockets 12*l* for holding a set of extension wands W used for varying length of an applicator wand used for directing cleaning solution through condenser coils as more fully detailed below.

Peripheral skirt 12*c* encircles the entire perimeter of base housing with a removable door panel 12*g* for access to the battery compartment. The skirt and base housing have a profile (or footprint) seen in FIG. 5 with rounded front, and flared sides joining a squared-off back end.

As shown in FIG. 5, an on/off switch 13 and a battery recharge jack 15 are located in recess 12*m* in the back end of skirt 12*c* as part of an electrical circuit substantially the same as that of modified embodiment described below with FIG. 9.

The carryall further comprises water container 14 and cleaning chemical container 16 mounted side-by-side on top of the strength wall 12*b* which forms the bottom of each container. Each container has a fill neck defining fill opening closed by a twist on/off closure cap.

Water container 14 has front 14*a*, back 14*b*, side 14*c-d*, top 14*e*, and bottom 12*b* walls defining a watertight interior space of approximately three-gallon capacity for cleaning water filled through opening 14*f* in fill-neck 14*g*. The opening is covered by a threaded closure cap 14*h*. The water container is molded of robust plastic and is formed integral with the base housing.

As shown in FIGS. 1-4, chemical container 16 is located beside water container and comprises sidewall 16*a*, a bottom wall 16*b* (FIG. 6) which serves also as a portion of strength wall 12*b* of base housing. Preferably, chemical container 16 is of 55 fl. ounce capacity. Container 16 has a separate fill opening 16*c* secured by twist-on/off closure cap 16*d*.

A generally vertical strength plate 18 occupies the space between containers and is integral with the container walls 14*b* and 16*a*. Strength plate side edges 18*a-b* follow the contour of and are integral with container shoulders 14*i* and 16*e*. Side edges 18*a-b* converge to define a strength plate top 18*c* as a connecting junction for one end of carry handle 20. Carry handle 20 has one end 20*a* integral with top 18*c* of the strength plate, and extends over top wall 14*e* of the water container with its other end 20*b* terminating in a junction of top wall 14*e* and fill neck 14*g*. A handgrip opening 22 is thus defined between handle and top wall, and is situated centrally of the carryall for balanced carrying of the apparatus with containers filled, and with operating components in normal locations.

Figure 3:
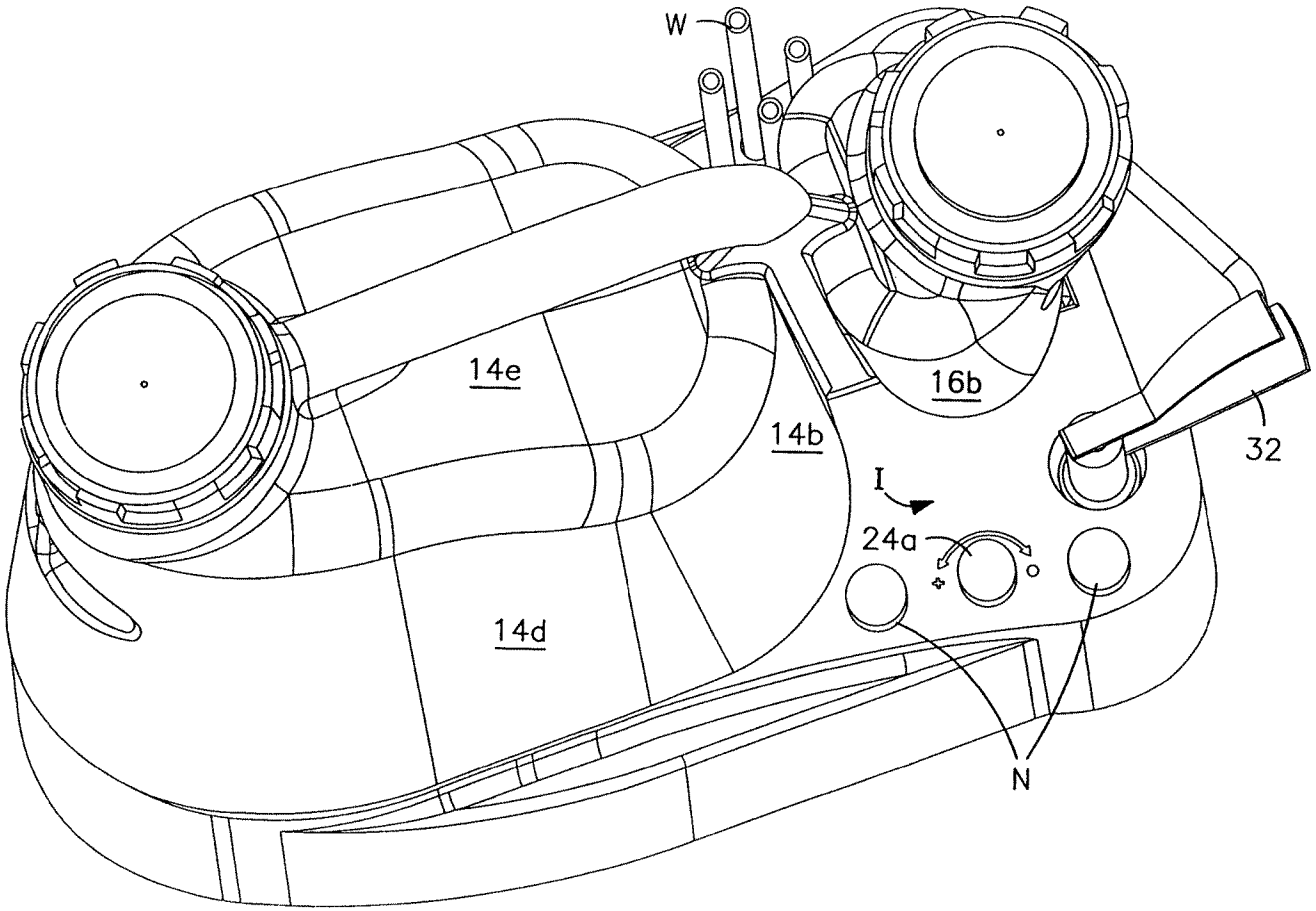
FIG. 3 is top perspective view of the left side of the apparatus of FIG. 1.
Figure 4:
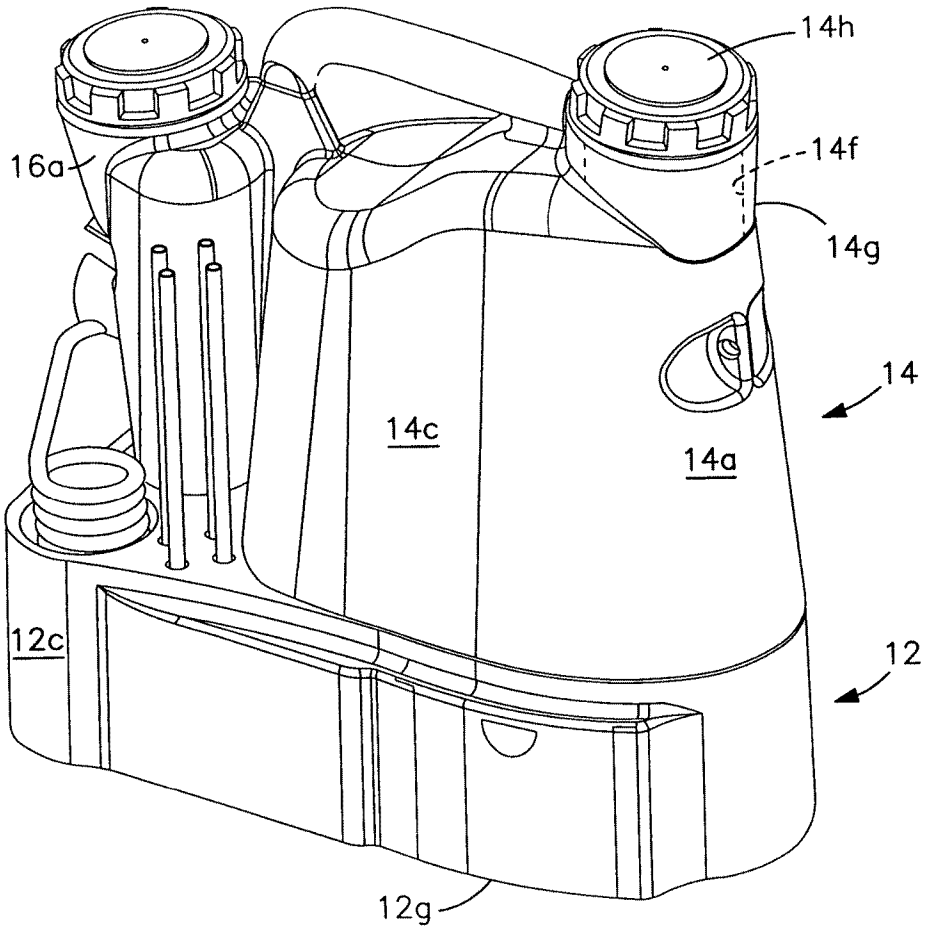
FIG. 4 is right side perspective of the apparatus of FIG. 1.
Figure 7:
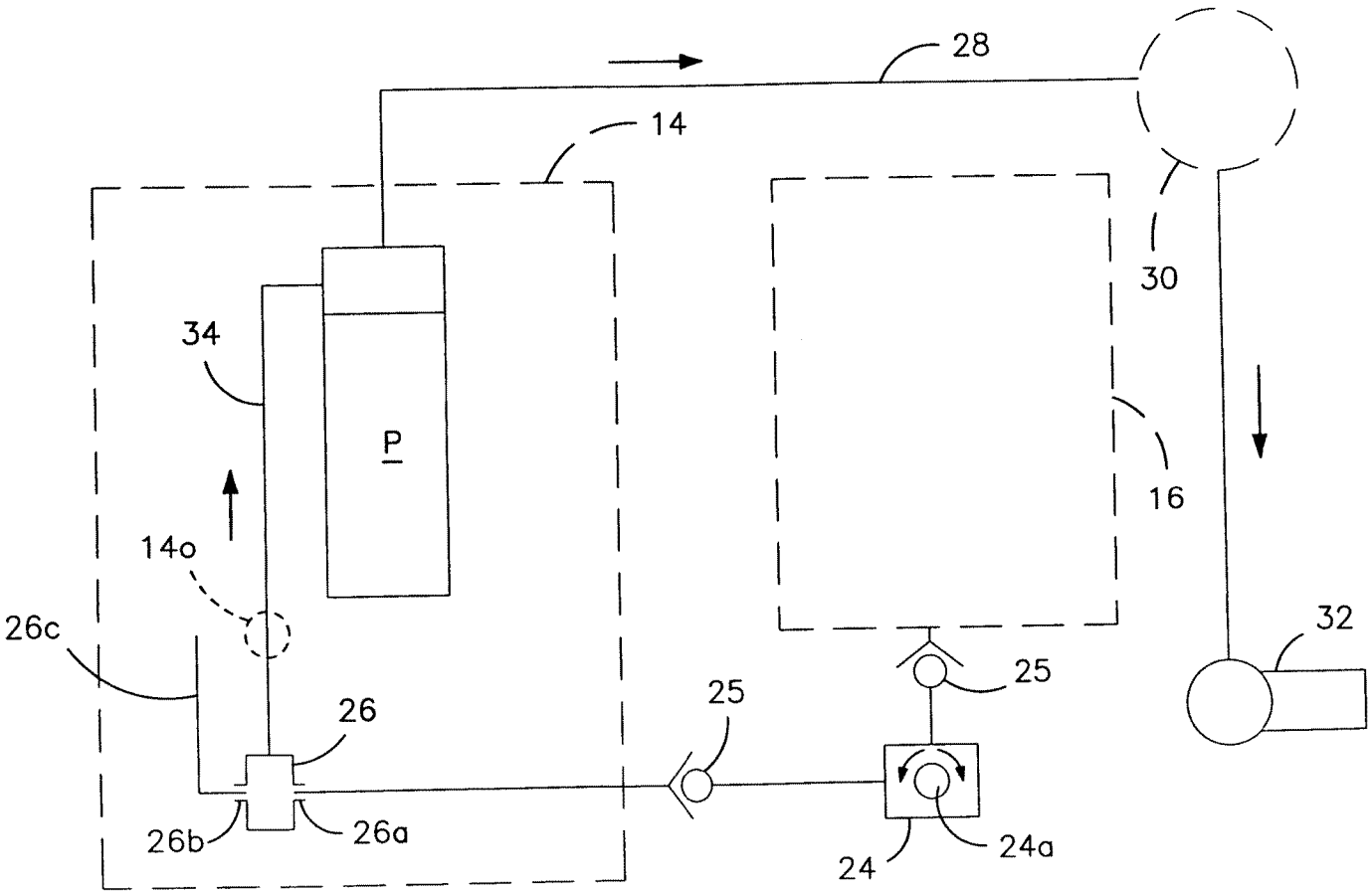
FIG. 7 is a line drawing of the plumbing system for preferred embodiment of the invention.

A schematic diagram of the plumbing system appears in FIG. 7, and includes motor pump P, water container 14, chemical container 16, a metering valve 24 with adjusting dial 24*a* for controlling the quantity of cleaning liquid from container mixed with water from container in a cleaning operation, one-way flow check valves 25, a three-way connector 26, and delivery line 28 including hose coil 30 and spray gun 32. As best shown in FIG. 3, metering valve adjusting dial 24*a* is located on strength wall 12*c* of the base. Indicia printed on the wall above the dial provide operating instructions for water/chemical dilution in terms of number of full rotations of the dial from a closed (water only) position designated by a minus sign. Specifically one full turn toward a plus sign equals 30:1 water/soap dilution; two turns 20:1; two and a half turns 10:1; three turns 6:1; and four turns 4:1.

Spare nozzles N of various spray patterns for the applicator wand are kept next to the adjusting dial.

In operation, the motor driven pump, which is located underneath strength wall 12*b* of water container, draws chemical/soap through metering valve 24 and through connector first port 26*a*, and draws water into connector second port 26*b* through water line 26*c* from water container 14. Pump suction line 34 passes through opening 14*o* in the water container and provides fluid flow into the pump. The pump delivers cleaning solution at approximately 0.5 gpm and up to approximately 120 psi in selected dilution.

Figure 8:
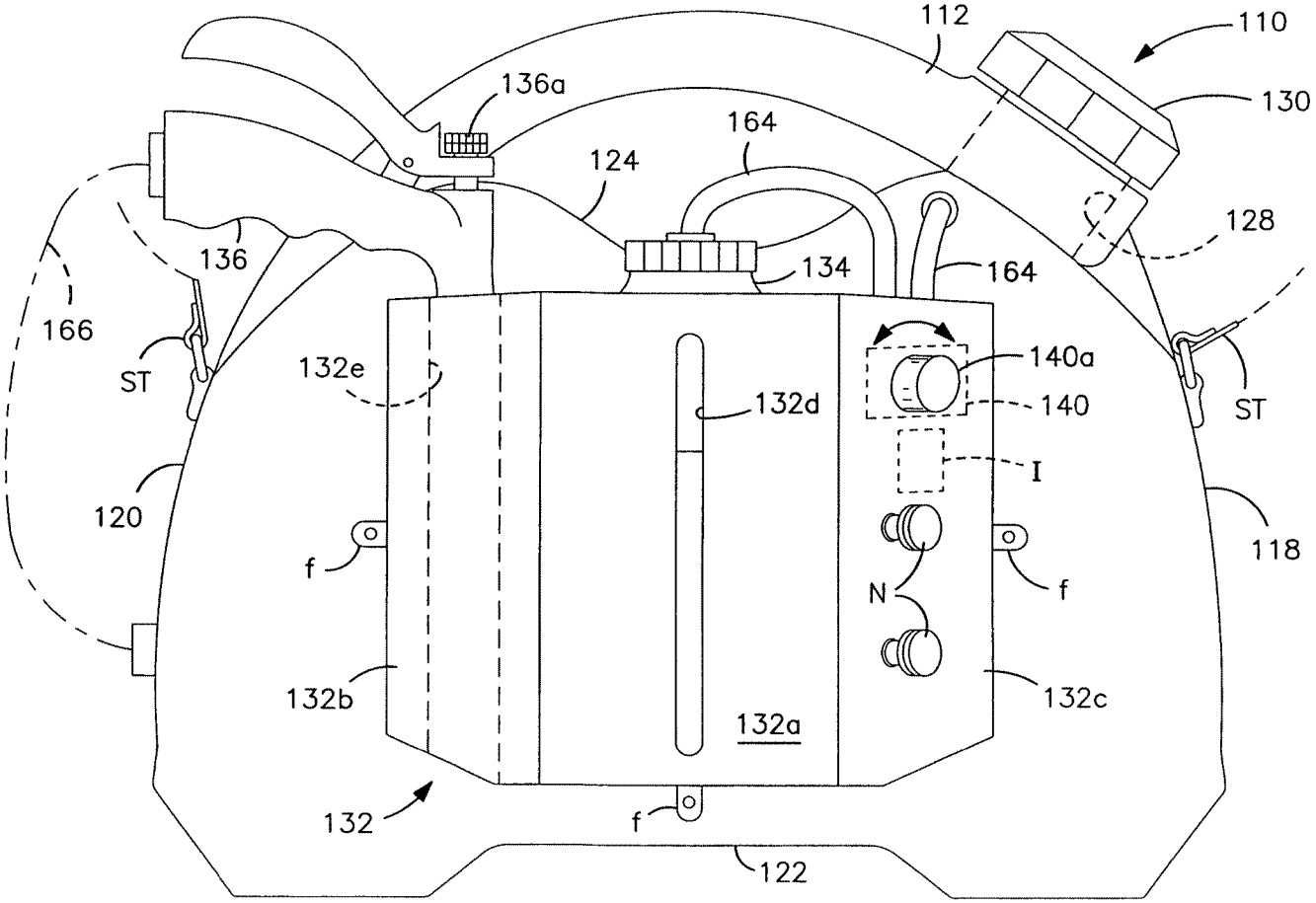
FIG. 8 is a front elevation view of a modified embodiment of coil cleaning apparatus according to the invention.
Figure 9:
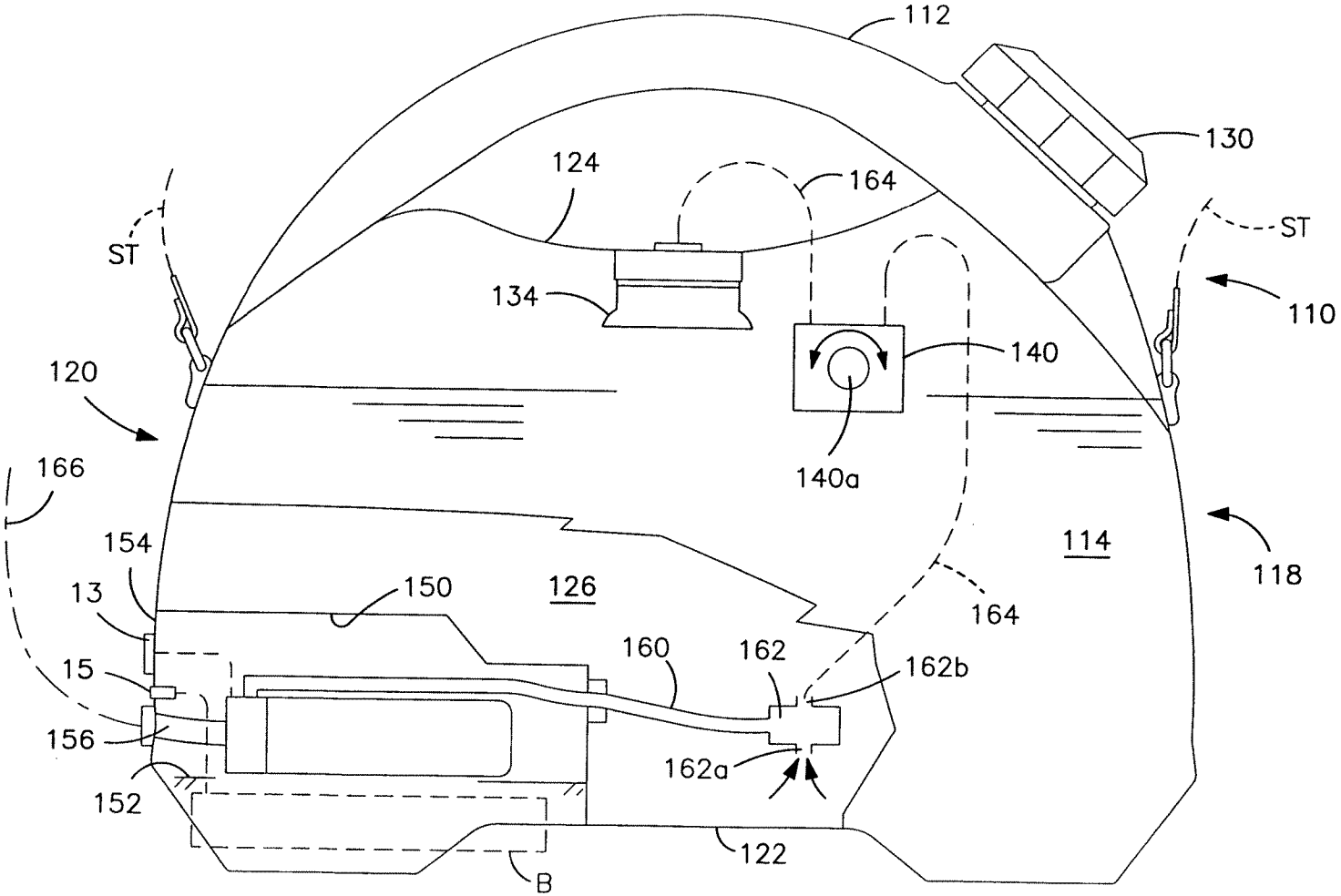
FIG. 9 is a front elevation view thereof partly broken away to show electrical and plumbing compartments of the coil cleaning apparatus of FIG. 8.
Figure 10:
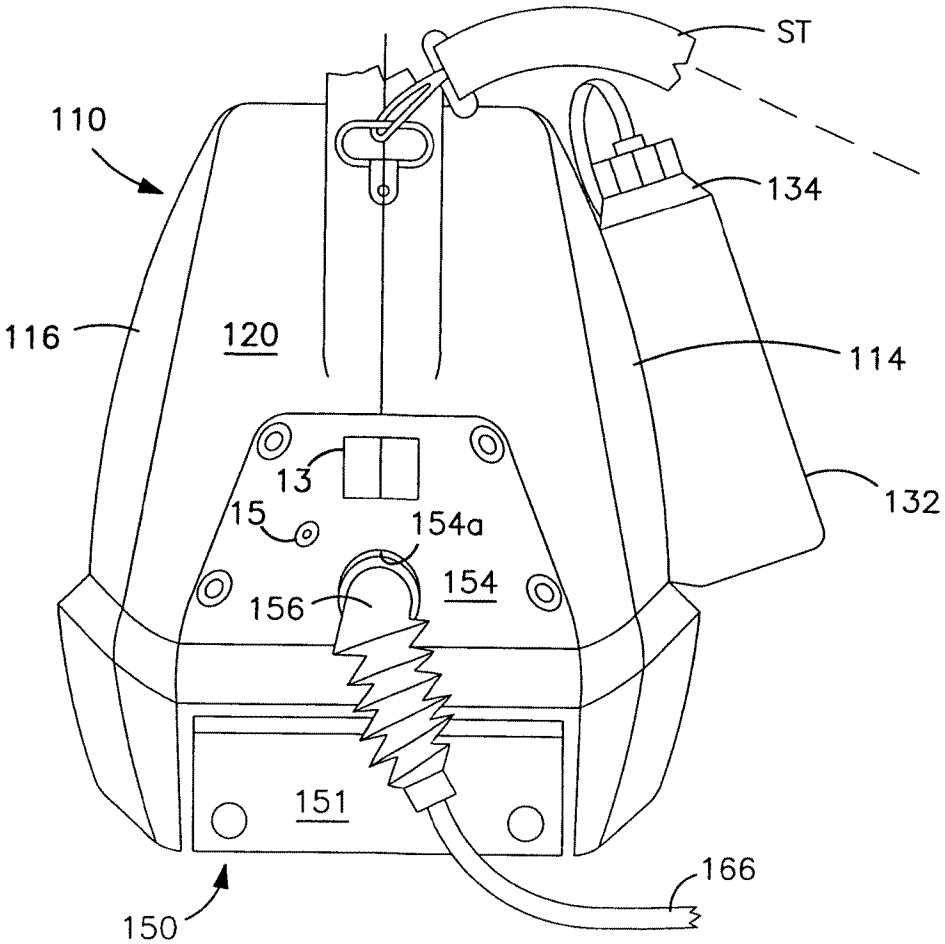
FIG. 10 is an end view of the apparatus of FIG. 8 showing cover plates and fittings for electrical and plumbing fittings, and cover plate for cleaning fluid container.

Referring to FIGS. 8-10 of the drawing, a modified embodiment of the apparatus of the invention comprises a tank 110 preferably of three gallon capacity molded of robust plastic such as polyethylene having an integral carrying handle 112, with front 114, back 116 (FIG. 10), end 118, 120, bottom 122, and top 124 walls defining a watertight interior space or container 126 of approximately three-gallon capacity for cleaning water filled through a large opening 128 for easy filling covered by twist closure cap 130.

A cover plate 132 for securing a separate soap or chemical container 134 is affixed by suitable fasteners f to the front wall of the tank. The cover plate 132 includes a central panel 132*a* generally parallel to front wall 114, and side panels 132*b-c* angled toward front wall so defining an interior space between cover plate and front wall for receiving container 134 of about ounce capacity. The central panel includes a vertical slit 132*d* as a sight level indicator of the amount of soap or chemical in container 134. The cover plate also provides a holster 132*e* in the form of a cylindrical pocket for pistol grip spray nozzle 136 described more fully below.

One of the side panels 132*c* is fitted with a metering valve 140 and adjusting dial 140*a* for controlling the quantity of cleaning liquid from container 134 mixed with water from container 126 in a cleaning operation. The panel also retains several nozzles N for use in varying spray patterns including flat spray and pinpoint spray nozzles.

As shown in FIGS. 9 and 10, an exterior compartment 150 for housing an electric storage battery B and motor driven pump P is molded through the bottom 122 and side 120 walls of the tank. A mounting bracket 152 fits into compartment 150 for supporting battery and motor driven pump. End wall cover plate 154 (FIG. 10) mounts an on/off switch 13 for the pump, a re-charge jack 15 for the storage battery, and discharge line 156 from the pump.

FIG. 10 illustrates an end of the tank showing battery cover plate 151 and motor pump cover plate 154 in place over exterior compartment 150. Plate 154 includes outlet opening 154*a* for discharge line 156 carrying pressurized cleaning fluid through hose 166 to spray handle 136 and applicator wand 170. On/off motor operating switch 13 and a battery re-charge connection 15 are also fitted through motor pump cover plate 154.

FIG. 10 also shows the cover plate 132 in position on front wall 114 for securing the soap/chemical container 134 to tank 110.

Plumbing components and lines are shown in FIGS. 8 and 9 including motor driven pump P with submerged suction line 160 to T-connector 162 for drawing water from tank container 126 through first port 162*a* and soap or chemical from container 134 through mixing valve 140 and feed line 164 through second port 162*b*. The metering or mixing valve 140 in feed line 164 provides a water-to-soap or chemical dilution range of 4:1 up to 60:1 selected by turning the adjustment dial 140*a* for desired mixture as described above for FIG. 7 of preferred embodiment.

Figure 11A:
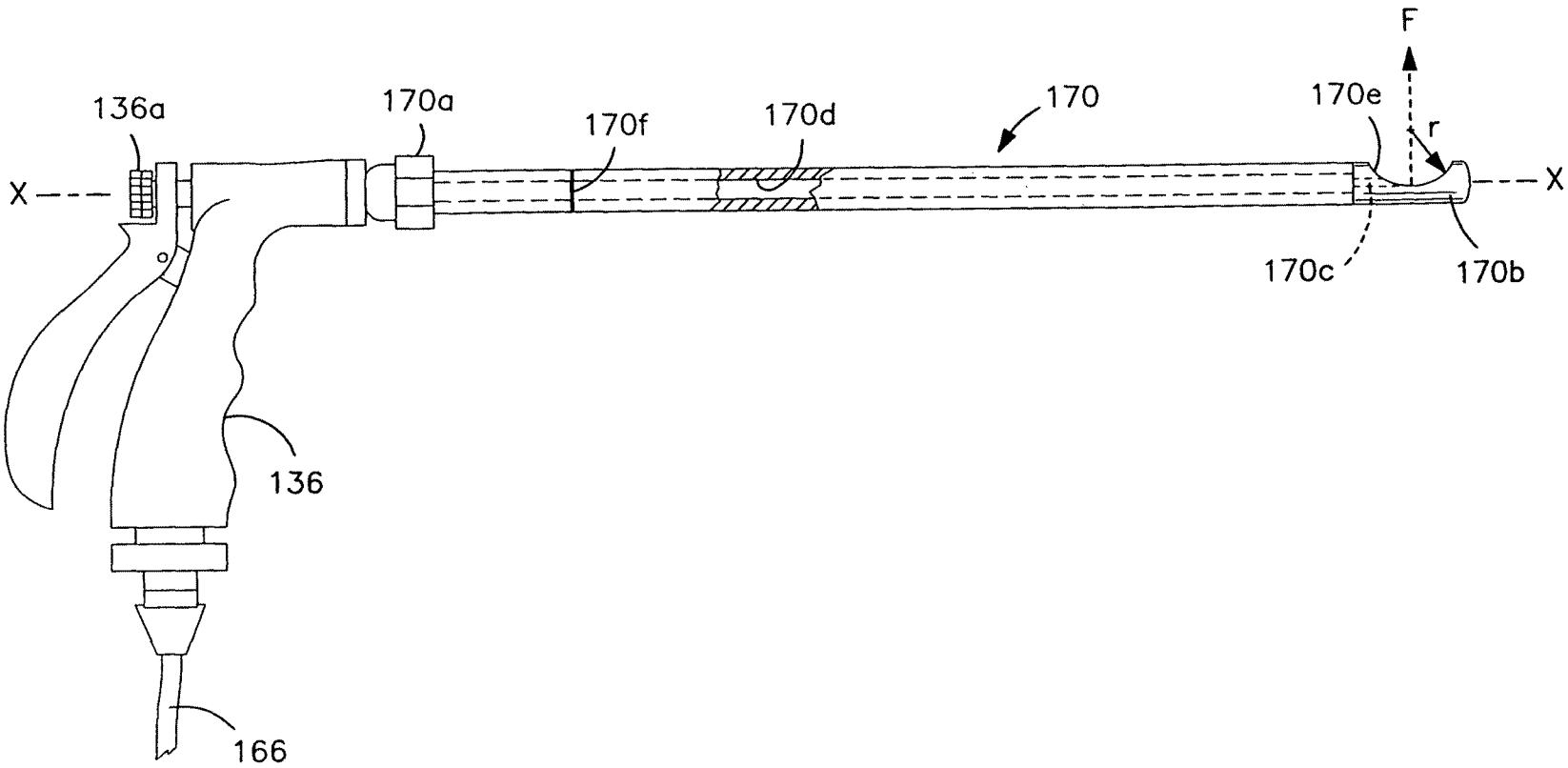
FIGS. 11*a-b* are side views of spray nozzle and applicator wands for use with preferred and modified embodiments of the invention.
Figure 11B:
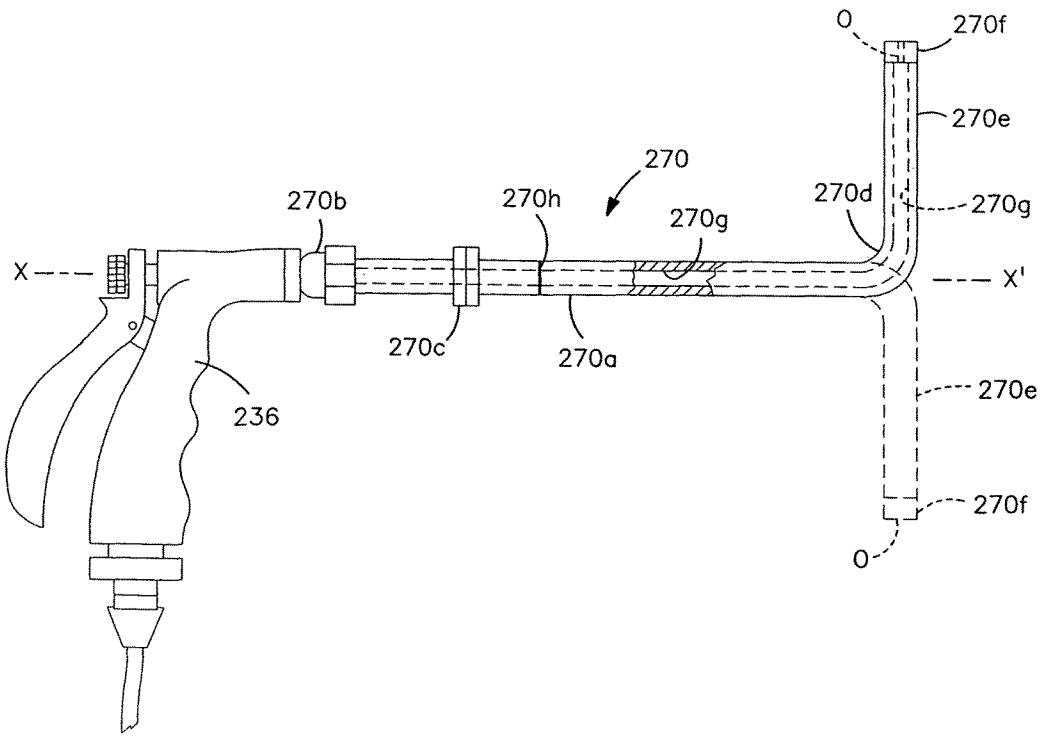
Figure 12:
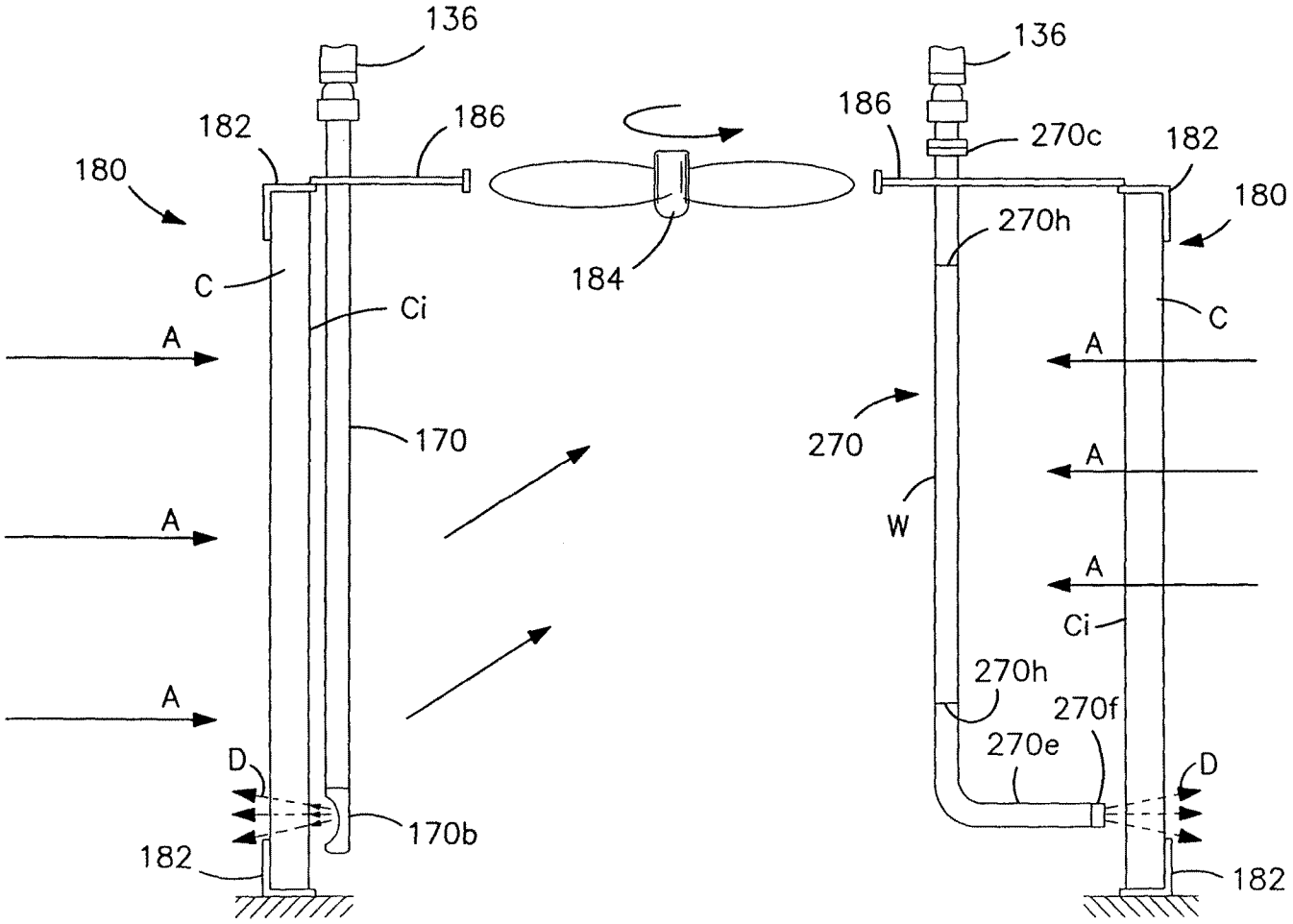
FIG. 12 is a schematic illustration of an outdoor condenser coil being cleaned according to the invention.

The cleaning mixture discharged from the pump through line 156 enters spray hose 166 controlled by pistol grip valve 136*a* and fitted with an applicator wand 170 and 270 shown in FIGS. 11*a*, 11*b* and 12. The pump delivers cleaning solution at approximately 0.5 gpm and up to approximately 120 psi in selected water-to-soap or chemical dilution.

Figure 13:
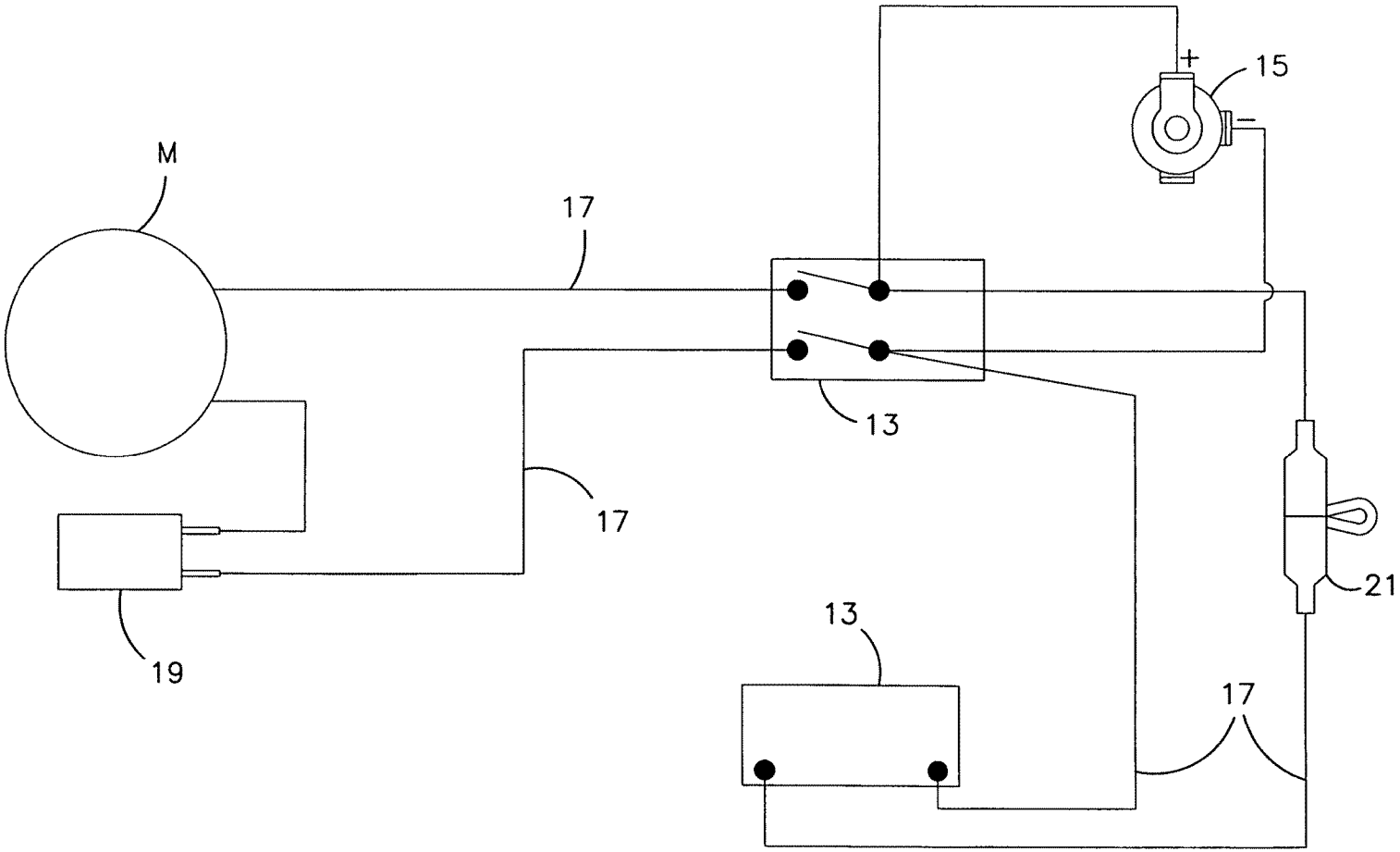
FIG. 13 is a line drawing of the electrical system for preferred and modified embodiments of the invention.

FIG. 13 shows a 12-volt electrical system for preferred and modified embodiments of the invention and comprises storage battery B powering motor M for driving pump P (FIG. 7) through power lines 17 fitted with on/off switch 13, pressure switch 19, recharging jack 15, and 10 amp fuse 21. The battery may be recharged from a technician's vehicle 12-volt system using jack 15. The pressure switch links to output line 28 (FIG. 7) from the pump for shutting down the system in the event output pressure falls below a desired level.

A preferred battery is 12 volt, 7-12 amp-hour, deep cycle, sealed lead acid. The battery charging system output through jack 15 is 12 v DC at 1 ampere taking 4-5 hours to charge a fully discharged battery. The charging unit can be left plugged in indefinitely without harming the battery. The electrical system is compact for placement within the both preferred and modified embodiments, packs sufficient power for use in cleaning multiple condenser coils without need for recharging, and provides for ease of recharging in a technician's work van when the apparatus is moved between work sites or overnight.

Applicator wand 170 (FIG. 11*a*) is an elongate rigid supply pipe or tube preferably stainless steel rotatably fitted at one end to pistol grip nozzle 136 with a quick connect fitting 170*a*, and having an approximately 90° spray nozzle 170*b* at its other end. Spray nozzle 170*b* is preferably a brass cylindrical body with an orifice 170*c* of smaller diameter than bore diameter 170*d* of its supply pipe for the purpose determining system flow at approximately 0.0.5 gpm. Minimum orifice size is 04. The cylindrical spray nozzle is recessed by arced wall 170*e* cut into the brass body to redirect flow F from the wand nozzle at 90° from axis x-x' of the wand. Arced wall 170*e* is a cylindrical wall having a radius r of approximately $\frac{5}{8}^{ths}$ inch with radius r lying in a common plane with axis x-x' and with the radius being tangent to the x-x' axis. It is to be understood that the wand is rotatable about axis x-x' with respect to spray handle 136 for issuing cleaning solution in any direction 360° normal to wand axis for cleaning condenser coils.

Applicator wand 270 (FIG. 11*b*) is an angled rigid supply pipe or tube 270*a* preferably stainless steel fitted at one end to pistol grip nozzle 236 with a quick connect fitting 270*b*, having a swivel joint 270*c*, and having an approximately 90° bend 270*d* of the tube to define wand stub 270*e* fitted with spray nozzle 270*f* at its other end. Spray nozzle 270*f* is preferably a brass cylindrical body with orifice O of smaller diameter than bore diameter 270*g* of its supply pipe for the purpose determining system flow at approximately 0.5 gpm. Minimum orifice size is 04. It is to be understood that the wand is rotatable at the swivel joint 270*c* with respect to spray handle 236 for issuing cleaning solution from nozzle 270*f* in any direction 360° normal to wand axis x-x' for cleaning condenser coils. The bend of the tube allows reach of end nozzle 270*f* to the surface of coils where the surface is laterally spaced from point of entry of wand into condenser unit as shown in FIG. 12.

Figure 11D:
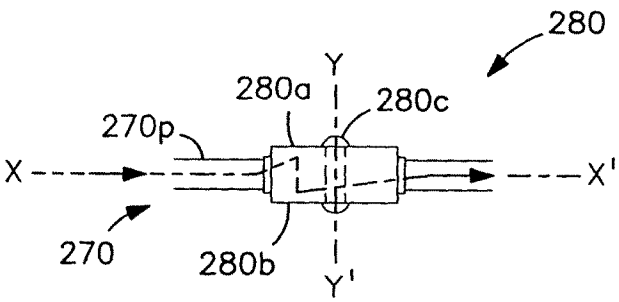
FIGS. 11*c-d* are side elevation and plan view respectively of a pivotal joint for applicator wand.
Figure 11C:
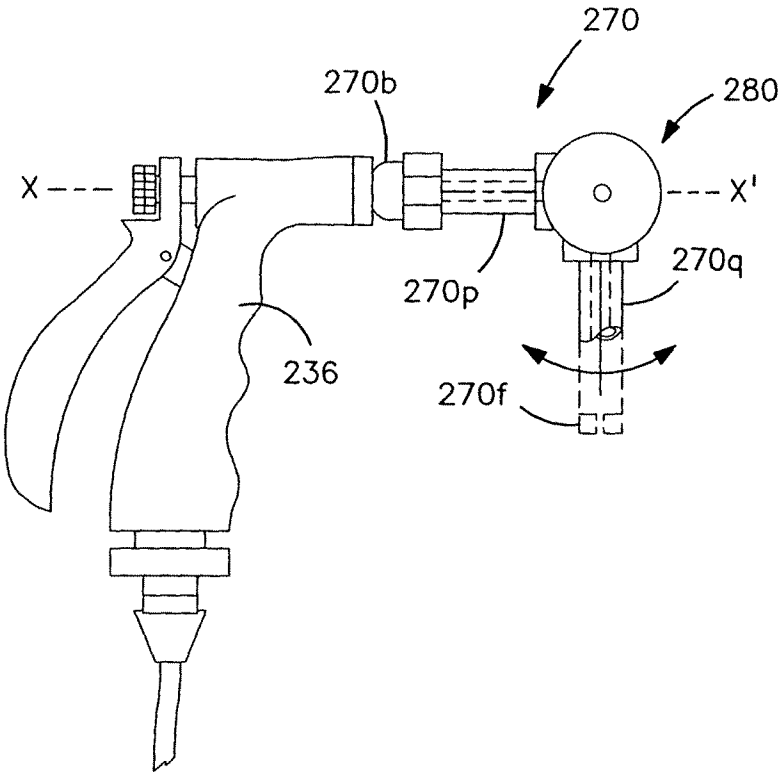

FIGS. 11*c-d* illustrate a pivoting joint 280 fitted to supply pipe 270 for rotating an applicator wand about y-y' axis normal to x-x' axis. Where pistol grip nozzle 236 is oriented vertically, pivot joint 280 permits movement of wand nozzle in a vertical plane about y-y' axis. As shown in FIG. 11*d*, the pivot joint 280 comprises stator 280*a* and rotor 280*b* shells held together by pivot pin 280*c* for rotor movement on y-y' axis. The stator is stationary with respect to pistol grip through pipe segment 270*p* so that the rotor move pipe segment 270*q* and nozzle 270*f* as indicated. Internal passages indicated by dash line accommodate fluid flow through the pivot joint. It is to be understood that both swivel and pivot joints maybe used together on a particular applicator wand for universal direction of spray from wand nozzle. Ordinarily, either a swivel joint or a pivot joint is used for applicator wands.

Applicator extension wands W (FIGS. 1 and 3) may be provided in several lengths for versatility of the invention in cleaning condenser coils. If desired, the applicator wands of FIGS. 10 and 11*b* may include socket joint 170*f* and 270*h* in its supply tube to accommodate extension wands W having mating socket ends for extending wand length as needed for cleaning coils of particular condenser units.

The preferred and modified embodiments of the invention are fitted with a shoulder carry strap ST of flexible web material such as nylon seen in FIGS. 6, 8 and 10. In the preferred embodiment strap ST is secured at opposite ends to the water container front wall 14*a* and chemical container wall 16*a* by suitable hardwear with the strap extending over the carryall in sufficient length to be carried from a technician's shoulder. A corresponding arrangement for the modified embodiment is shown in FIGS. 8 and 10.

FIG. 12 illustrates schematically an internal arrangement of components of a HVAC condenser unit 180 including coil and fin banks C mounted vertically by unit frame 182 around the periphery of the condenser unit, and a horizontally oriented motor driven fan 184 for drawing ambient air A through coil banks C to cool refrigerant flowing through the coils. A grille 186 comprising an open bar structure secures the fan in place over the condenser unit so that the entire inside surface $C_i$ of each bank of coils is accessible to applicator wands 170 and 270 passed through grille openings for applying cleaning solution through the coils in an interior-to-exterior direction D against flow of incoming cooling air represented by arrow A. It is to be appreciated that inflowing air A over time draws debris such as insects and grass clippings into the coil and fin banks so as to diminish thermal efficiency of the coils. Applicants have observed that cleaning solutions applied in the same direction of air flow tend to drive lightly lodged debris further into coil and fin banks thereby exacerbating loss of thermal efficiency, and complicating the job of properly cleaning the coils. Applicants have determined that by directing a cleaning solution of up to approximately 0.5 gpm at up to approximately 120 psi from the interior side of the coil is highly effective in dislodging debris lightly lodged at the exterior side of the coil and fin network. It is to be further understood, that by reason of the apparatus according to the invention including the applicator wand, it is not necessary to dismantle the condenser fan 184 and supporting grille work 186 for attaining access to the interior face $C_i$ of each coil bank in the condenser unit. The applicator wands enable a technician to reach the entire inner surface of each coil bank for application of cleaning solution. In the case of applicator wand 270, an extension wand W may be used along with stub 270*e* to attain proper vertical and horizontal reach of nozzle 270*f* near to interior face $C_i$ of coil bank C.

A technician equipped with a preferred or modified apparatus according to the invention proceeds as follows in cleaning a coil bank:

1. supplying up to three gallons of water and up to approximately 55 fluid ounces of a cleaning fluid of either liquid soap or liquid chemical;
2. mixing a cleaning solution of either soap or chemical cleaning fluid with water in a water-to-cleaning fluid dilution ratio in a range of 4:1 to 60:1;
3. pressurizing the cleaning solution up to approximately 120 psi;
4. establishing a flow rate of up to approximately 0.5 gpm through an applicator wand;
5. applying the cleaning solution by the applicator wand to the interior surface of coil banks in a condenser unit in a direction of flow interior-to-exterior of the condenser unit directly against the exterior-to-interior flow of ambient air into the condenser coils banks to dislodge debris lodged in the exterior surface of the coil banks; and 6. applying a rinsing solution to the exterior surface of the coils to remove dislodged debris and residual cleaning solution.

With the apparatus and method of the invention, technicians may now clean coils from the inside forcing debris back out. A powerful spray drives cleaning solutions through delicate fins without harming them and thoroughly rinses coils. An aerated nozzle, one of accessory nozzles provided, creates thick foam that penetrates deep into coils. Both preferred and modified embodiments have unique portable design, robust construction, an interchangeable deep cycle 12*v* rechargeable battery, and copious fluid capacity with an adjustable soap/chemical and water flow rate. The apparatus and method are for use in tough to reach areas, are designed for a realistic HVAC service atmosphere, and can be continuously used where electricity is not available. The apparatus obviates the need to drag hoses as well as separate pump sprayers to a work site. The apparatus has extended reach for washing elevated coils, can clean coils in limited access areas, and by reason of unique applicator wands, obviates time consuming need for dismantling condenser units for interior access to coils. Finally, a technician is able to recharge the battery in a work vehicle.

Various changes may be made to the structure embodying the principles of the invention. At several places in the specification values are indicated as being approximate, which is to be understood as covering a range of 20% plus to 20% minus the value indicated. The foregoing embodiments are set forth in an illustrative and not in a limiting sense. The scope of the invention is defined by the claims appended hereto.

What is claimed is:

1. An applicator wand for use in cleaning coils of a condenser unit of an HVAC installation with cleaning solution, the wand comprising a handheld spray nozzle having an outlet port for receiving a rotatable, fluid tight connection, a nozzle rod in the form of a rigid tube with an x-x' axis connected at one end to said outlet port, the nozzle rod having an interior axial passage for cleaning fluid, the nozzle rod having at its other end an outlet nozzle, the outlet nozzle having a duct of lesser size than the passage of the nozzle rod to set fluid flow at approximately 0.5 gpm, the nozzle rod being bent intermediate its ends at an approximately 90° degree angle to define a rigid nozzle stub extending at said angle from the x-x' axis, the nozzle rod and the nozzle stub being of rigid unitary construction on either side of the bent 90° angle, the nozzle rod tube having a swivel joint at which the nozzle rod is rotatable on its x-x' axis with respect to the handheld spray nozzle so that the nozzle stub can emit cleaning solution in any direction 360° of the x-x' axis, the swivel joint positioned in the nozzle rod adjacent the spray nozzle for easy access by the wand user, and a socket joint in the nozzle rod between the swivel joint and the nozzle stub, and at least one wand inserted between swivel joint and nozzle stub for extending wand length.

* * * * *